United States Patent [19]

Smith et al.

[11] 4,126,177

[45] Nov. 21, 1978

[54] DUAL SCRAPED SURFACE HEAT EXCHANGER

[75] Inventors: Robert L. Smith; Carl C. Yann, both of Louisville, Ky.

[73] Assignee: Chemetron Corporation, Chicago, Ill.

[21] Appl. No.: 776,137

[22] Filed: Mar. 10, 1977

[51] Int. Cl.[2] ..... F28D 11/02

[52] U.S. Cl. ..... 165/91; 165/94; 165/109; 165/120; 165/169

[58] Field of Search ..... 165/90, 91, 94, 109, 165/120, 169

[56] References Cited

U.S. PATENT DOCUMENTS

| | | | |
|---|---|---|---|
| 3,216,042 | 11/1965 | Strittmatter | 165/94 X |
| 3,405,760 | 10/1968 | Smith | 165/94 |
| 3,476,522 | 11/1969 | Stovall | 165/94 X |
| 3,587,729 | 6/1971 | Eisenmann | 165/94 |
| 3,603,103 | 9/1971 | Richmond et al. | 165/120 X |
| 3,628,602 | 12/1971 | Brunner | 165/94 X |
| 3,641,783 | 2/1972 | Werner | 165/94 X |
| 3,731,339 | 5/1973 | Addison | 165/94 X |
| 3,805,406 | 4/1974 | Castonoli | 165/90 X |

FOREIGN PATENT DOCUMENTS

| | | | |
|---|---|---|---|
| 446,739 | 5/1936 | United Kingdom | 165/91 |
| 1,147,897 | 4/1969 | United Kingdom | 165/91 |

*Primary Examiner*—Ira S. Lazarus
*Attorney, Agent, or Firm*—Vincent G. Gioia

[57] ABSTRACT

A heat exchanger for rapidly heating or cooling materials such as fluids containing fragile, discrete particles of varying sizes without substantial damage to the particles. The exchanger has inner and outer heat transfer surfaces that define an elongated annulus. Located in the annulus is a pair of opposed, spiral, inner and outer ribs which do not span the annulus and which, upon rotation, move the material toward the exchanger inlet against the flow therefrom which overflows the ribs and moves from rib to rib and to the outlet. Scraper blades associated with the ribs, scrape the exchanger inner and outer surfaces.

10 Claims, 6 Drawing Figures

DUAL SCRAPED SURFACE HEAT EXCHANGER

BACKGROUND OF THE INVENTION

1. Field of the Invention.

This invention pertains to scraped surface heat exchangers.

2. Description of the Prior Art.

A conventional dual scraped surface heat exchanger utilizes inner and outer heat transfer surfaces to maintain a desired surface to volume ratio by suitable selection of the inner and outer diameters. In a single surface heat exchanger, the surface to volume ratio would decrease with an increase in diameter. With two surfaces involved, scraping both surfaces with a single spiral rib or flight, which would also convey the material through the heat exchanger, presents a difficult manufacturing problem due to the clearances encountered. Further, the single rib would positively advance the material and could damage the fragile, discrete particles therein as a resistance is encountered such as adjacent a discharge.

SUMMARY OF THE INVENTION

Applicants, as a consquence, designed a heat exchanger that meets their requirements and avoids the disadvantages of the prior art. Applicants' specific problem is the efficient (and non-destructive) heating of materials such as fillings for pies. The filling might include, besides the fluid portion, cherries, blueberries, strawberries, or peach slices 3 inches long by 0.75 inches wide. A particle of size of an inch cube is the nominal requirement. Obviously, mutilation of the fruit would reduce its desirability. In view of this, Applicants designed a heat exchanger having dual surfaces for efficient heat transfer. For material travel therethrough, Applicants designed means for non-positive material travel. Specifically, Applicant's means includes a pair of opposed spiral ribs or flights. The ribs are located in the elongated annulus between the heat transfer surfaces. One rib extends from about the center of the annulus to adjacent the outer surface and the other rib from about the center to adjacent the inner surface. Located between the ribs are pairs of scraper blades with one blade scraping the outer surface and the other blade the inner surface. The structure noted, upon rotation, is designed to move the material toward the exchanger inlet against the flow therefrom which overflows the ribs and moves from rib to rib and to the outlet. By regulation of the flow to the exchanger inlet and the speed of rotation of the ribs, the best heat exchanger efficiency can be selected with the least damage to the particles.

It is, therefore, an object of this invention to provide a new and improved dual scraped surface heat exchanger.

Another object of this invention is to provide a dual scraped surface heat exchanger having non-positive material travel.

DESCRIPTION OF THE PREFERRED EMBODIMENT

Figure 1:
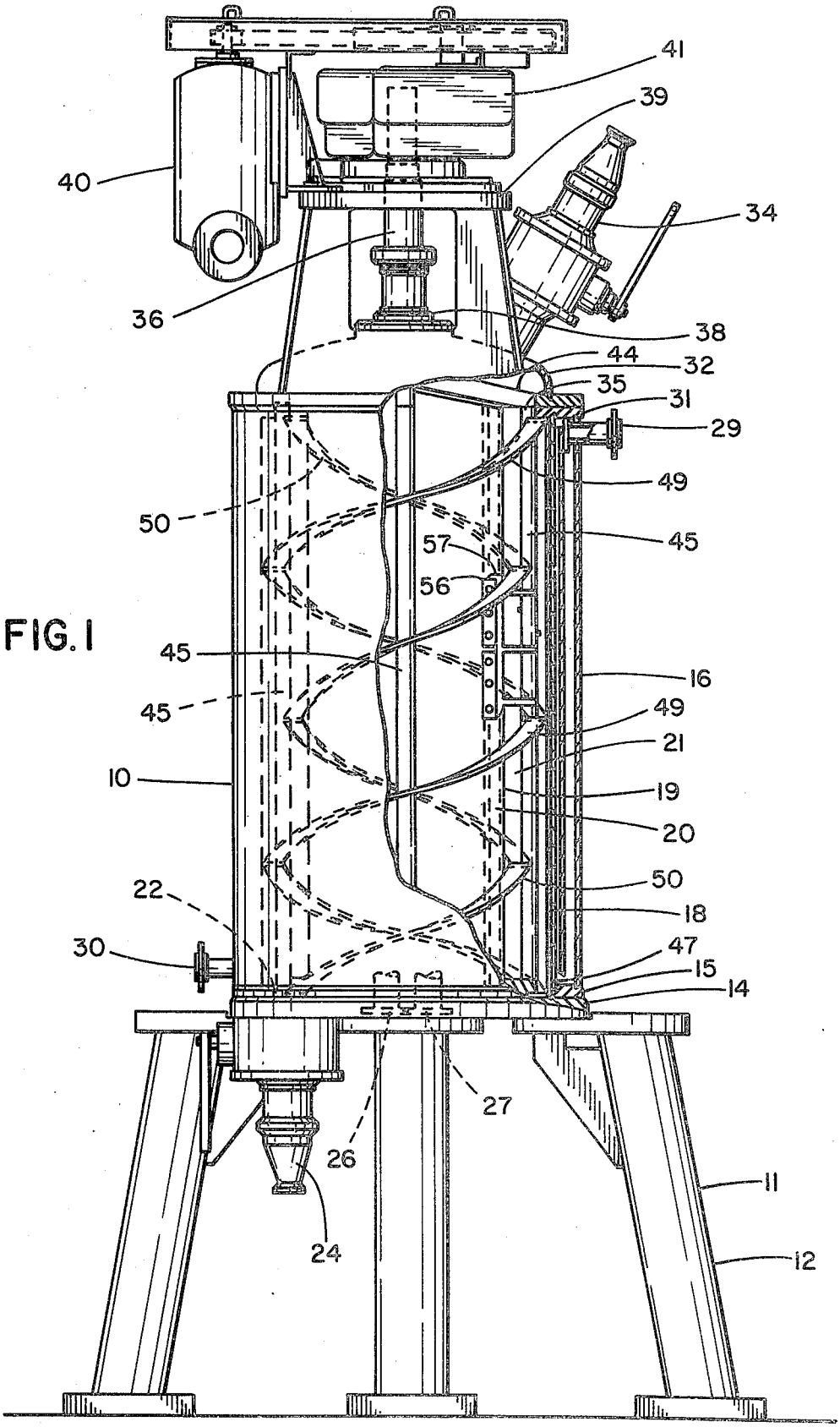
FIG. 1 is a somewhat schematic elevational sectional view (partially cut away) of the heat exchanger of this invention.

Referring to FIG. 1, 10 indicates a heat exchanger of the dual surface variety which is preferably vertically oriented. Heat exchanger 10 has a base 11 consisting of preferably three equi-spaced legs 12. Legs 12 have ends adapted to be fixedly connected to a suitable mounting surface and other ends adapted to be connected to the heat exchanger proper at its base plate 14.

Plate 14 encloses the bottom of the heat exchanger proper and is connected by suitable capscrews to lower plate 15 extending between outer heating jacket 16 and associated drum 18. Welded top plate 14, is inner pipe 19 (which is closed at the top), as is inner heating jacket 20 which extends around the interior of pipe 19. Annulus 21 is bounded by the exterior of pipe 19 and the interior of drum 18 and provides passage for the material to be treated by heat exchanger 10.

Base plate 14 has opening 22 adapted to be closed by outlet ball valve 24 which provides a material discharge from annulus 21 and therefore from heat exchanger 10. Pipes 26 and 27 extending through a central opening in plate 14 provide access for a heating medium to communicate with inner heating jacket 20 of pipe 19.

Outer jacket 16 has lateral upper flanged opening 29 for the inlet of a heating medium (which is preferably steam) and a lower flanged opening 30 which serves as an exit. Top closure plate 31, which is connected by welding to jacket 16 and drum 18, closes the outer heating jacket. Cover 32, attached to plate 31 by suitable capscrews, closes the top of heat exchanger 10. Inlet ball valve 34 connected in cover 32 provides material access to the heat exchanger.

Figure 3:
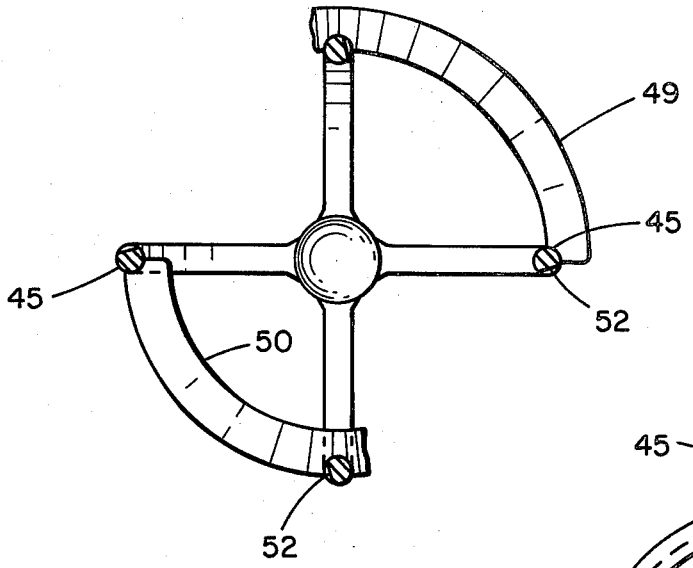
FIG. 3 is a sectional view taken on line 3—3 of FIG. 2.
Figure 4:
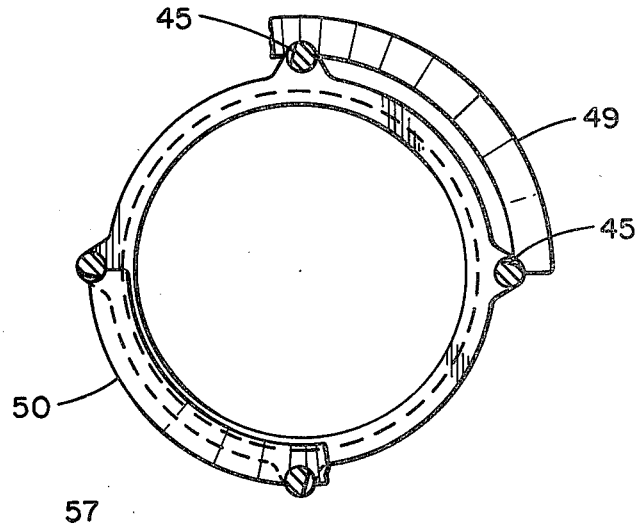
FIG. 4 is a sectional view taken on line 4—4 of FIG. 2.

Located in annulus 21 for rotation therein is the conveyor portion 35 of heat exchanger 10. Conveyor or mover portion 35 (also see FIGS. 2, 3 and 4) includes shaft 36 which is rotatably supported in the exchanger by bearing assembly 38 mounted on cover 32. Suitable bracket 39 mounted on cover 32 provides support for a variable drive means 40 connected to a suitable speed reducer 41 by a drive belt. Reducer 41 is connected directly to shaft 36 at its drive end to cause rotation of conveyor portion 35.

Also a part of conveyor portion 35 are 4 equi-spaced arms 44 welded to shaft 36. The other end of each arm is connected to an end of post 45. Each post extends parallel to shaft 36. Connecting the ends of posts 45 remote from the arms 44 is circular base 47. Circular base 47 with bearing 48 (See FIG. 2) therebetween rotatably supports conveyor portion 35 on a suitable surface of inner pipe 19 in annulus 21.

Outer rib or flight 49 having a right hand orientation encircles posts 45 (See particularly FIGS. 3 and 4) and is rigidly connected thereto. As shown in FIG. 1, rib 49 extends from approximately the center of annulus 21 to close to the inner surface of drum 18. Suitable plastic strips may be attached to rib 49 to ensure limited clearance therebetween to restrict material flow thereby. Inner rib or flight 50 also having a right hand orientation is connected to the interior of posts 45. Rib 50 contacts posts 45 on opposite sides of conveyor portion 35 from rib 49. (See FIGS. 3 and 4) Rib 50 extends from approximately the center of annulus 21 to adjacent the outer surface of inner pipe 19. Plastic strips may be also attached to rib 50 to ensure limited clearance therebetween to restrict material flow thereby. Preferably ribs 49 and 50 have the same pitch. Conveyor portion 35 is adapted to be rotated in the clockwise direction when viewed from the bottom of exchanger 10 to cause material in annulus 21 to move upward toward inlet valve 34 from whence material enters exchanger 10. Also to be noted is the limited radial clearance between ribs 49 and 50 as shown best in FIG. 2.

Figure 2:
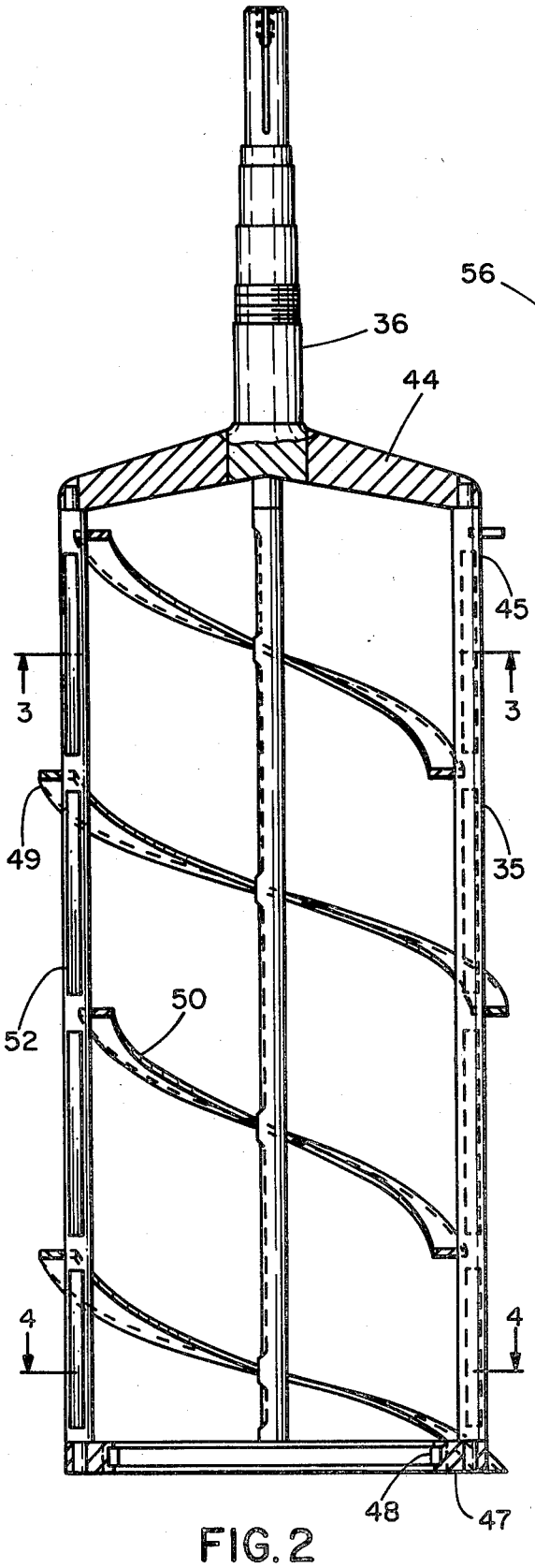
FIG. 2 is a sectional, elevational view of the conveyor portion of the heat exchanger.
Figure 5:
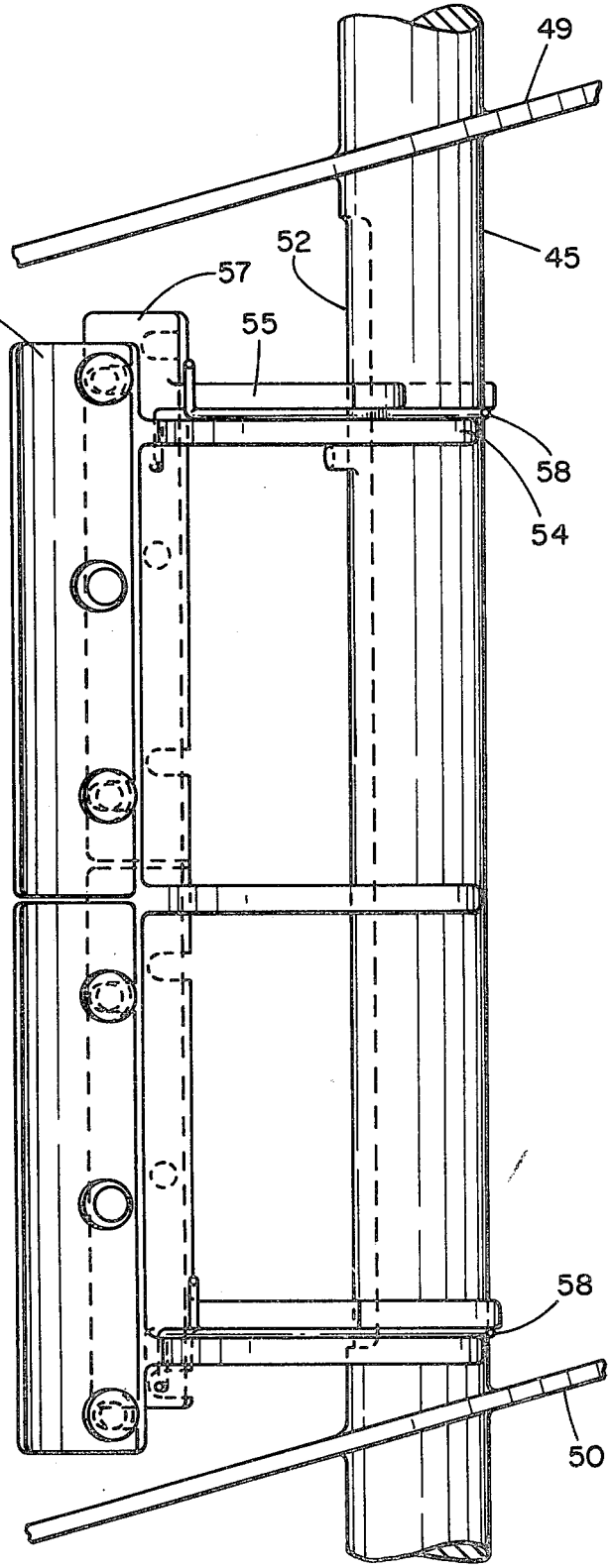
FIG. 5 is an elevational view of the scraper portion of the heat exchanger.
Figure 6:
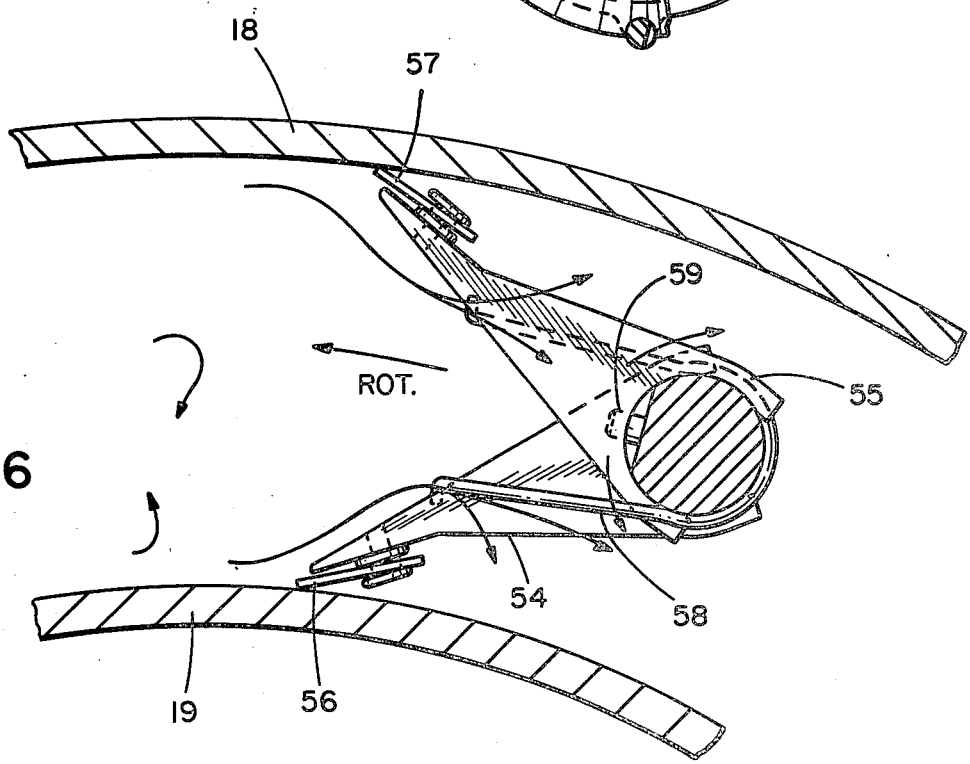
FIG. 6 is a plan view of the scraper portion.

For efficient heat exchanger operation, the annulus surfaces of drum 18 and pipe 19 are scraped of material thereon. As best shown in FIGS. 2, 5 and 6, each post 45 has a flatted surface 52 extending between ribs 49 and 50. Inner blade carrier 54 has a suitable surface adapted for sliding on post 45 via flatted surface 52 and is then rotated to a desired position adjacent pipe 19. Outer blade carrier 55 is somewhat similarly constructed to be installed on the same post and then rotated adjacent drum 18. When confined in annulus 21, the carriers cannot leave post 45. To achieve the proper surface to scraper angle, inner carrier 54 has the angled construction shown best in FIG. 6. Suitable blades 56 attached to carrier 54 by pins and 57 for carrier 55 actually engage the heat exchanger surfaces. Spring 58 extending between carrier 54 and 55 biases the blades against the exchanger surfaces. Top view (FIG. 6) also shows the counter clockwise rotation of conveyor portion 35 and the scraping of material from the exchanger annulus (see arrows). Other arrows depict material flow to the center of the annulus. A stop pin 59 maintains the scraping assemblies in proper longitudinal position. Also noted in FIG. 6 is the flow of the scraped material over the blades and between the arms of the blade holders. A minimum of obstructions is desired to prevent material retention.

In operation, material which may contain fragile, discrete particles is introduced into the top portion of exchanger via inlet valve 34. Preferably flow is controlled by the material dispensing apparatus which may be associated with the heat exchanger although a limited control is possible by ball valve 34. Other valves could be utilized for improved flow control. The material, which may be introduced into the exchanger in a batch or continuous process enters annulus 21 through cover 32. With a heating medium circulating through outer jacket 16 (when it is desired to heat a pie filling) and through inner jacket 20, the longitudinal surfaces of the annulus 21 are heated and this heat is applied to the material. The rotation of conveyor portion 35 (and thus ribs 49 and 50) causes movement of the material upward against the flow from inlet valve 34. Particles in particular are moved up the outer rib 49 and the inner rib 50. Since the radial space therebetween is limited, the fluid portion of the material overflows each rib as it moves from rib 49 to 50 and down through the exchanger to outlet valve 24. Some particles are moved from rib to rib where they are continually being moved toward valve 34. The result is a non-positive conveying of primarily the particles toward the material inlet which eventually ends in discharge from the outlet 24 of the exchanger. By suitable adjustment of the speed of the conveyor portion 35 and the material inflow, the best combination of heating efficiency and low particle mutilation can be achieved. Inner and outer blade carriers 54 and 55 rotate with the conveyor portion and, via the blades, essentially scrape the drum 18 and the pipe 19 surfaces which define the annulus. Suitable longitudinal spacing of the blades results in substantially the entire length of the annulus being scraped for efficient heat transfer.

Although outer rib 49 and inner rib 50 are slightly radially spaced they could be overlapping to further increase the overflow effect from outer rib to inner rib to outlet via the center of the annulus and thus to the exchanger outlet with each rib providing a lifting force therebetween. Of course, the exchanger could utilize cooling mediums in the jacket to cool the material rather than heating same and still impart the non-positive material travel.

We claim:

1. A heat exchanger comprising:

(a) a drum having an inlet and an outlet for material to be moved therethrough;

(b) a first jacket for a heat exchange medium mounted on said drum and substantially surrounding the outside of said drum;

(c) a pipe mounted within said drum and coaxial therewith;

(d) a second jacket for a heat exchange medium mounted on said pipe and substantially extending around the inside of said pipe, said pipe and said drum defining an elongated annulus therebetween for the passage therethrough of the material;

(e) means rotatably mounted in said annulus for moving the material toward said inlet against the material flow therefrom, said means comprising:

(1) a pair of opposed spiral ribs, one rib being located adjacent said drum and extending toward said pipe and the other rib being located adjacent said pipe and extending toward said drum;

(2) a plurality of pairs of scraper blades extending between said ribs for scraping said drum and said pipe; and (f) driving means to rotate said means and said ribs to move the material toward said inlet with a portion of the material flow from the inlet moving from rib to rib to the outlet.

2. The heat exchanger of claim 1 in which said inlet is on one end of the drum and said outlet is on the other end.

3. The heat exchanger of claim 2 in which said one rib and said other rib extend toward substantially the center of the annulus.

4. The heat exchanger of claim 3 in which said ribs are radially spaced.

5. The heat exchanger of claim 3 in which said rotatably mounted means further comprises; four equispaced posts extending parallel to said pipe, and said one rib extending around the outside of said posts and said other rib extending around the inside of said posts.

6. The heat exchanger of claim 5 in which said plurality of scraper blades are mounted on said posts.

7. The heat exchanger of claim 6 further comprising biasing means extending between each of said pairs of scraper blades to maintain contact with said pipe and drum.

8. The heat exchanger of claim 7 in which said rotatably mounted means further comprises; a shaft connected to said driving means and four arms connected to said shaft, each arm having an end connected to a post and a base connected to other ends of said posts and bearing means between said base and said pipe.

9. The heat exchanger of claim 8 further comprising means to vary the speed of said driving means.

10. The heat exchanger of claim 9 further comprising means in communication with said inlet to vary the flow therefrom.

* * * * *